US009216576B2

(12) United States Patent
Kobayashi et al.

(10) Patent No.: US 9,216,576 B2
(45) Date of Patent: Dec. 22, 2015

(54) INKJET HEAD WITH DAMPER MEMBER IN COMMON INK CHAMBER, AND METHOD FOR DRIVING INKJET HEAD

(71) Applicant: Konica Minolta, Inc., Tokyo (JP)

(72) Inventors: Ryohei Kobayashi, Hino (JP); Masato Ueda, Hachioji (JP); Kazuki Hiejima, Hachioji (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/469,713

(22) Filed: Aug. 27, 2014

(65) Prior Publication Data

US 2015/0138282 A1 May 21, 2015

(30) Foreign Application Priority Data

Aug. 27, 2013 (JP) ..... 2013-176017
May 27, 2014 (JP) ..... 2014-109140

(51) Int. Cl.
*B41J 2/045* (2006.01)
*B41J 2/14* (2006.01)
*B41J 2/055* (2006.01)

(52) U.S. Cl.
CPC ..... *B41J 2/14201* (2013.01); *B41J 2/04543* (2013.01); *B41J 2/04581* (2013.01); *B41J 2/04588* (2013.01); *B41J 2/055* (2013.01); *B41J 2/14209* (2013.01); *B41J 2/14233* (2013.01); *B41J 2002/14419* (2013.01); *B41J 2002/14459* (2013.01)

(58) Field of Classification Search
CPC .... B41J 2/14233; B41J 2/04525; B41J 2/161; B41J 2002/14459; B41J 2002/11; B41J 2002/14491; B41J 2002/18
See application file for complete search history.

(56) References Cited

U.S. PATENT DOCUMENTS 7,497,557 B2 * 3/2009 Sugahara ..... 347/68

FOREIGN PATENT DOCUMENTS

| | | | | |
|---|---|---|---|---|
| JP | 2007118312 A | | 5/2007 | |
| JP | 2007168185 | * | 5/2007 | ..... B41J 2/055 |
| JP | 2007168185 A | | 7/2007 | |
| JP | 2012106513 A | | 6/2012 | |

* cited by examiner

*Primary Examiner* — Juanita D Jackson
(74) *Attorney, Agent, or Firm* — Cantor Colburn LLP

(57) ABSTRACT

An inkjet head includes pressure chambers arranged in 2 or more rows and a common ink chamber connected to all the pressure chambers, wherein each of the pressure chambers includes a damper member inside of the common ink chamber of the inkjet head for commonly supplying an ink from the common ink chamber via an ink inlet which faces the common ink chamber, and the shortest distance between the damper member and the ink inlet is made shorter than the distance between ink inlets in adjacent rows of pressure chambers.

15 Claims, 7 Drawing Sheets

INKJET HEAD WITH DAMPER MEMBER IN COMMON INK CHAMBER, AND METHOD FOR DRIVING INKJET HEAD

CROSS REFERENCE TO RELATED APPLICATIONS

The present invention claims priority under 35 U.S.C. §119 to Japanese Application No. 2013-176017 filed Aug. 27, 2013 and Japanese Application No. 2014-109140 filed May 27, 2014, the entire content of which is incorporated herein by reference.

TECHNICAL FIELD

The present invention relates to an inkjet head and a method for driving an inkjet head, and more specifically to an inkjet head capable of reducing the impact between rows of pressure chambers derived from a crosstalk and a method for driving an inkjet head.

BACKGROUND

In industrial inkjet technological development, it has been a major trend to use more nozzles and rows in an inkjet head. Accordingly, it has become increasingly difficult to equalize the ejection performance of each nozzle.

As one example, an ink ejection property can be nonuniform due to a variation in pressure wave or temperature distribution according to how an inkjet head is driven. An inkjet head is configured in such a manner that pressure chambers are arranged in a plurality of rows and ink inlets of the pressure chambers between the rows are connected by a common ink chamber. In this configuration, a pressure wave generated in a pressure chamber by driving one row of pressure chambers is propagated to another row of pressure chambers via the common ink chamber, and a variation in ejection property of the pressure chambers having the propagated pressure wave is caused as "crosstalk problem."

Meanwhile, introduction of advanced inkjet technology has achieved a lower nozzle unit cost, thereby providing a lower product cost in more simplified structure. Consequently, development of a high productive inkjet head is being required.

Conventionally proposed example of a technology capable of reducing the impact between pressure chambers derived from a crosstalk includes an inkjet head comprising a wall surface member which intersects an extension line of a straight line connecting an ink inlet and an ink outlet of a pressure chamber which is made of a material of which the volume elastic modulus is not greater than 40 GPa (for example, refer to Patent Document 1), an inkjet head with a damper wall which faces a common ink chamber and elastically deforms (for example, refer to Patent Document 2), and an inkjet head with a damper member having a damper chamber which is filled with air in a common ink chamber (for example, refer to Patent Document 3).

PRIOR ART DOCUMENTS

Patent Documents

Patent Document 1: JP-A-2007-168185
Patent Document 2: JP-A-2012-106513
Patent Document 3: JP-A-2007-118312

As an inkjet head has more rows of pressure chambers, a variation in ink ejection property becomes larger. In particular, when 3 or more rows of pressure chambers are employed, a pressure wave generated in the middle row of pressure chambers affects 2 adjacent rows of pressure chambers, resulting in nonnegligibly larger extent of crosstalk between the rows and more significant variation in ink ejection property.

In fact, inkjet heads disclosed in Patent Documents 1 and 2 are simple in structure due to a damping function of a pressure wave by one wall surface of a common ink chamber. However, as more rows of pressure chambers are installed, a damping effect of the pressure wave could be insufficient. This is because as a result, the amount of an ink supplied to the pressure chambers becomes larger, thereby requiring a larger volume of a common ink chamber. Accordingly, the distance between an ink inlet of the pressure chambers and a wall surface having a damping function of a pressure wave becomes longer.

An inkjet head disclosed in Patent Document 3 is not prone to such a problem as mentioned above due to a structure of disposing a damper member in a common ink chamber as an independent member, but this document fails to disclose a solution to a crosstalk problem between rows of pressure chambers.

Patent Document 2 discloses a solution to a crosstalk problem between rows of pressure chambers. Specifically, a narrowed portion for lessening the cross-sectional area of a flow passage in a common ink chamber is formed by providing a partition wall in the common ink chamber. Nevertheless, it is necessary to form a narrowed portion in addition to a damper member in a common ink chamber, resulting in more complicated structure and higher product cost.

SUMMARY OF THE INVENTION

The objective of the present invention is to provide an inkjet head capable of reducing the impact of crosstalk between rows of pressure chambers arranged in 2 or more rows in simplified configuration and achieving stable ink ejection properties.

In addition, when an inkjet head which is provided with a damper member in a common ink chamber is driven with a high frequency of 15 kHz or more, a pressure wave generated by drive is continuously damped and reflected to generate regular uneven pressure. This type of uneven pressure, even if slight, can be visually confirmed as a change in liquid amount or uneven concentration.

Another objective of the present invention is to provide a method for driving an inkjet head capable of reducing uneven concentration by controlling an uneven pressure wave during a high-frequency drive in an inkjet head which is provided with a damper member in a common ink chamber.

Other objectives of the present invention can also be described as follows.

An inkjet head can be subjected to a nonuniform ink ejection property from a pressure wave generated by drive. This is because a pressure wave generated in a pressure chamber by drive is propagated to other pressure chambers connected by a common ink chamber, and the ink ejection property of the pressure chambers having the propagated pressure wave varies (crosstalk).

Conventionally proposed example of a technology capable of reducing the impact between pressure chambers derived from a crosstalk includes an inkjet head comprising a wall surface member which intersects an extension line of a straight line connecting an ink inlet and an ink outlet of a pressure chamber which is made of a material of which the volume elastic modulus is not greater than 40 GPa (Patent Document 1), an inkjet head with a damper wall which faces a common ink chamber and elastically deforms (Patent Document 2), and an inkjet head with a damper member having a damper chamber which is filled with air in a common ink chamber (Patent Document 3).

In recent years, an inkjet head has been required to have a capability of recording a finer image with a higher speed. Thus, an inkjet head capable of recording a high-density image by arranging side by side a plurality of rows of a plurality of pressure chambers is being proposed.

Meanwhile, inventors of the present invention found that by driving an inkjet head having a plurality of rows of pressure chambers, the impact of crosstalk is more significant than an inkjet head having one row of pressure chambers to obviously demonstrate a problem of a variation in ink ejection property.

Specifically, an inkjet head which is configured in such a manner that a plurality of rows of pressure chambers are provided and ink inlets of the pressure chambers between the rows are connected by a common ink chamber affects the ink ejection property of other rows of pressure chambers after a pressure wave generated in a pressure chamber by driving the rows of the pressure chambers is propagated to other rows of the pressure chambers via the common ink chamber.

It is known that inkjet heads described in Patent Documents 1 and 2 employ a member having a function of damping a pressure wave for a wall surface of a common ink chamber in order to control an acoustic crosstalk. To this end, however, in cases where a wall surface of a common ink chamber is essentially placed near an ink inlet which opens in a common ink chamber, the common ink chamber becomes narrow accordingly, thereby failing to provide a volume large enough to store a required amount of an ink.

Meanwhile, an inkjet head described in Patent Document 3 is configured to dispose a damper member in a common ink chamber as an independent member, thereby advantageously disposing a damper member according to an intended use and provide a sufficient volume of a common ink chamber. Nevertheless, a damper member with air filled in a damper chamber is mostly provided with a flexible film on a damper surface. Thus, a damper surface protrudes in a direction of pressure chambers from expansion of air in a damper chamber due to a thermal impact by driving an inkjet head or by an ink such as a gel UV ink and a ceramic ink to be ejected heated by using a heater. Accordingly, an ink flow passage to the pressure chamber will be narrowed to possibly prevent smooth ink supply.

Patent Document 3 describes a requirement of setting the air pressure in a damper member at atmospheric pressure or more. Specifically, as the air temperature rises in operation, the volume of a damper chamber grows due to air expansion and the air pressure in the damper member increases to over atmospheric pressure to improve damping characteristics. Obviously, Patent Document 3 completely fails to take into account narrowing of an ink flow passage from expansion of a damper member.

An objective of the present invention is to provide an inkjet head which is provided with a damper member having a damper effect which never narrows an ink flow passage after a damper surface protrudes in a direction of pressure chambers.

Another objective of the present invention is to provide a method for producing a damper member capable of readily producing a damper member which is provided with a damper effect which never narrows an ink flow passage after a damper surface protrudes in a direction of pressure chambers.

The above-described problems can be solved by each of the following inventions.

An inkjet head, including: pressure chambers arranged in 2 or more rows; and a common ink chamber connected to all the pressure chambers, each of the pressure chambers accepting an ink commonly supplied from the common ink chamber via an ink inlet which faces the common ink chamber and ejecting the ink from nozzles connected to an ink outlet of the pressure chambers due to a change in pressure generated in the pressure chambers, the inkjet head further comprising a damper member inside of the common ink chamber, wherein the shortest distance between the damper member and the ink inlet is shorter than the distance between the ink inlets in adjacent rows thereof.

Preferably, the shortest distance between the damper member and any of the ink inlets is the same.

Preferably, the common ink chamber comprises only one the damper member, wherein the damper chamber is disposed so as to bridge across all the rows of the pressure chambers.

Preferably, the damper member includes all the ink inlets when the damper member is projected from a direction perpendicular to a plane where the ink inlets are present.

Preferably, the ink inlet, the ink outlet and the nozzles are disposed on a straight line and the straight line and the damper member intersect.

Preferably, a partition wall between adjacent the pressure chambers contains a piezoelectric element, and an ink in the pressure chambers is pressurized due to deformation of the partition wall to eject the ink from the nozzles.

Preferably, a member having a volume elastic modulus of 40 GPa or more is disposed in parallel with the damper member around the ink inlets.

Preferably, the damper member comprises a damper chamber having a sealed gas.

Preferably, the damper member is formed of a flexible film on at least one face of a housing, the damper chamber is formed of the housing and the flexible film, and the flexible film is disposed so as to face the ink inlets.

Preferably, the housing contains a metal.

Preferably, the pressure inside of the damper member is atmospheric pressure or less when the temperature of an ink of the common ink chamber reaches the working temperature.

Preferably, the damper member is a plate member obtained by forming a wall surface which faces at least the ink inlets of a material having a volume elastic modulus of 40 GPa or less.

Preferably, one wall surface of the pressure chambers is formed of a diaphragm obtained by laminating piezoelectric elements, and an ink in the pressure chambers is pressurized due to vibration of the diaphragm to eject the ink from the nozzles.

Preferably, the inkjet head including: pressure chambers arranged in 2 or more rows; and a common ink chamber connected to all the pressure chambers, each of the pressure chambers accepting an ink commonly supplied from the common ink chamber via an ink inlet which faces the common ink chamber and ejecting the ink from nozzles connected to an ink outlet of the pressure chambers due to a change in pressure generated in the pressure chambers, the inkjet head further comprising a damper member inside of the common ink chamber, wherein the shortest distance between the damper member and the ink inlet is shorter than the distance between the ink inlets in adjacent rows thereof, the pressure chambers are divided into N drive groups: N is an integer of 2 or more, and the drive timing is shifted by $(2n-1)$ AL: $0.8<n<1.2$, AL is one half of the acoustic resonance period of the pressure chambers according to each of the drive groups.

Preferably, the drive groups are divided according to a row of the pressure chambers as a unit.

Preferably, adjacent rows of the pressure chambers are divided into the different drive groups.

Preferably, the drive frequency is 15 kHz or more.

DESCRIPTION OF THE PREFERRED EMBODIMENTS

Preferred embodiments of the present invention will be described in detail with reference to the drawings.

(First Embodiment of Inkjet Head)

Figure 1:
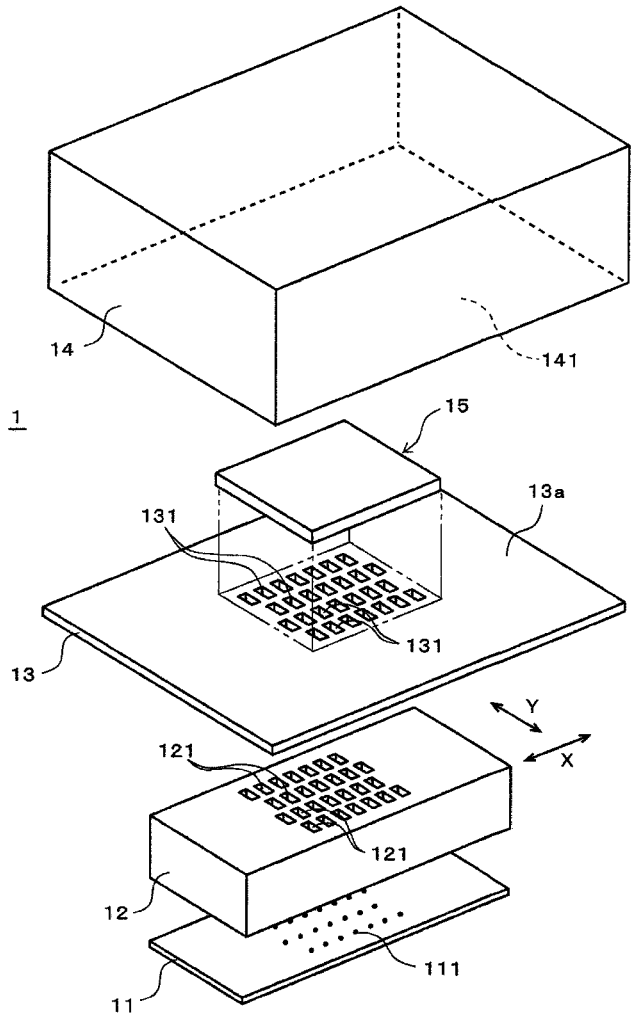
FIG. 1 is an exploded perspective view showing a first embodiment of an inkjet head according to the present invention.
Figure 2:
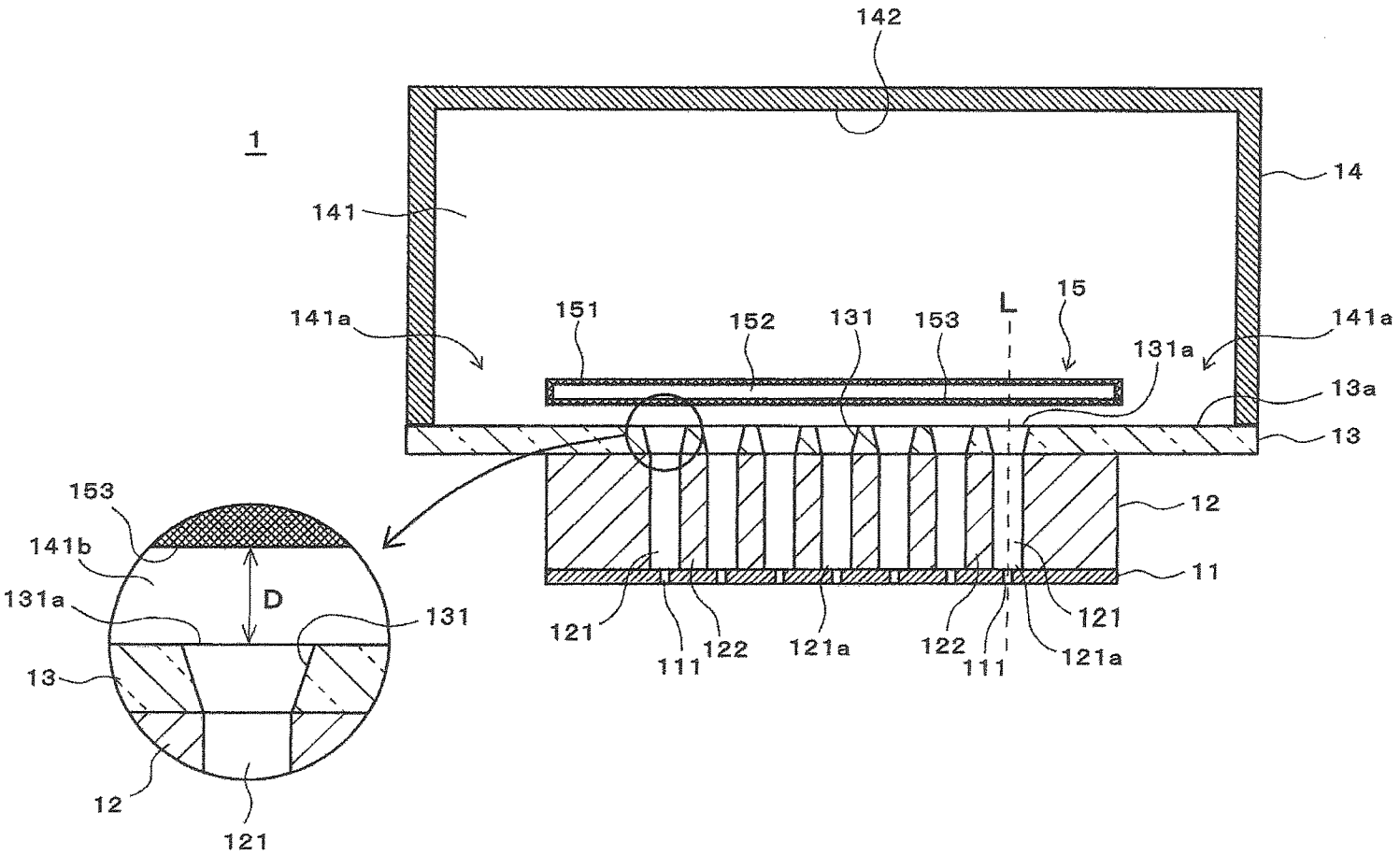
FIG. 2 is a cross-sectional view of the inkjet head shown in FIG. 1.
Figure 3:
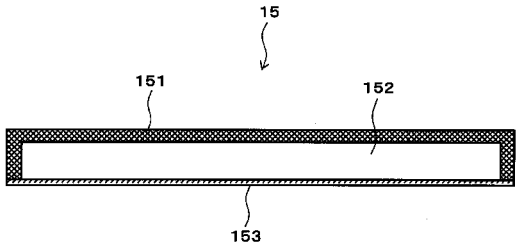
FIG. 3 is a cross-sectional view of a damper member.

FIG. 1 is an exploded perspective view showing a first embodiment of an inkjet head according to the present invention, FIG. 2 is a cross-sectional view of an inkjet head thereof, and FIG. 3 is a cross-sectional view of a damper member.

As shown in FIG. 1, an inkjet head 1 comprises a nozzle plate 11, a head chip 12, a substrate 13 and an ink manifold 14, which are joined to each other. A damper member 15 is disposed inside of a common ink chamber 141 formed of an internal space of the ink manifold 14.

The head chip 12 is formed of a hexahedron, and a plurality of channels 121 which function as a pressure chamber in the present invention are arranged therein. Each of the channels 121 is formed so as to be penetrated on a straight line between a face on the nozzle plate 11 of the head chip 12 and a face of the substrate 13 of the head chip 12, and one row of channels are formed by arranging side by side a plurality thereof in X direction in FIG. 1. A plurality of rows of channels are formed by arranging side by side in Y direction intersecting the X direction.

This embodiment shows 7 by 4 rows of channels arranged side by side extending in X and Y directions, respectively. The number of one row of channels 121 in the present invention is not particularly restricted. The number of rows of channels may be 2 or more, preferably 3 or more. Since use of 3 or more rows of channels can propagate a pressure wave generated in one row of channels to 2 adjacent rows of channels thereof, the impact of crosstalk becomes significant, thereby demonstrating advantageous effects by the present invention.

A row of channels (row of pressure chambers) is an assembly of channels 121 (pressure chambers) for forming a recording width of an image recorded on a recording medium with a predetermined width during relative movement of an inkjet head 1 and a recording medium in one direction.

The recording width is a width of an image formed when conveying a recording medium e.g. in cases where the inkjet head 1 is fixedly disposed on the recording medium and the recording medium is conveyed in one direction to record an image. X direction for arranging rows of channels in the inkjet head 1 is not restricted to a direction parallel to a width direction of a recording width of an image formed on the recording medium, but may be a direction intersecting the recording width aslant.

To make a relative movement of the inkjet head 1 and the recording medium, an embodiment of fixedly disposing the inkjet head 1 and conveying the recording medium is used. In addition, an embodiment of recording an image by subjecting the inkjet head 1 to scanning movement in width direction of the recording medium and moving the recording medium in a direction intersecting a scanning movement direction of the inkjet head 1 during one scanning movement, and an embodiment of recording an image by fixedly disposing the recording medium and subjecting the inkjet head 1 to scanning movement in width direction of the recording medium and moving the recording medium in a direction intersecting a scanning movement direction of the inkjet head 1 during one scanning movement may be employed.

By setting the internal pressure of a space formed of a later-described damper frame and a flexible film at a negative pressure, the impact of crosstalk: the impact of a pressure wave generated in one row of channels in 2 or more rows of channels on adjacent rows of channels thereof can be prevented. When an inkjet head having 3 or more rows of channels is used, the impact of crosstalk can become more significant because a pressure wave generated in one row of channels provides an impact on adjacent rows of channels thereof. Even in the above case, the inkjet head can preferably be used by setting the internal pressure of a space formed of a later-described damper frame (or a housing) and a flexible film (or a damper wall) at a negative pressure.

In the head chip 12, a partition wall 122 for dividing between adjacent channels 121, 121 in each row of channels includes a piezoelectric element, and a driving electrode (not shown) is formed on both surfaces of each partition wall 122. The partition wall 122 is subjected to shear deformation after a predetermined voltage of a driving signal is applied on a driving electrode on both surfaces of the partition wall 122, thereby changing the volume in the channel 121 sandwiched by a pair of partition walls 122, 122. Accordingly, an ink supplied to the channel 121 is pressurized to be ejected, and an ink droplet is ejected from nozzles 111 formed at a nozzle plate 11 so as to be connected to an ink outlet 121*a* of the channel 121. The ink outlet 121*a* is a lower opening in the channel 121 shown in FIG. 2.

A plurality of nozzles 111 is formed at the nozzle plate 11. Each of the nozzles 111 is connected to the ink outlet 121*a* of the channel 121. An ink in the channel 121 which is pressurized to be ejected from deformation of the partition wall 122 is ejected from the nozzles 111 via the ink outlet 121*a*. The ink outlet 121*a* is an opening of a lower channel 121 in the head chip 12 shown in FIG. 2.

The substrate 13 is a flat thin plate having a larger area than the head chip 12, and formed of glass, ceramics, silicon, synthetic resin, etc. On a surface of this substrate 13 facing the head chip 12, electrodes (not shown) which are electrically connected to each driving electrodes of the head chip 12 are formed. Consequently, a region protruding from the head chip 12 also functions as a connecting portion of the electrode and an external wiring member such as FPC (not shown). In a region where the head chip 12 is joined on a substrate 13, a through hole 131 is individually formed so as to correspond to each of the channels 121 of the head chip 12. In the substrate 13 of this embodiment, 7 through holes 131 are arranged side by side in X direction in FIG. 1 to form one row, and this row is further formed in 4 additional rows in Y direction. The inside of each of the channels 121 is connected to a through hole 131 corresponding thereto. An opening of the head chip 12 of the through hole 131 is almost the same as an opening of the channel 121 in area, and is formed so as to show the same shape as the opening of the channel 121.

An ink manifold 14 is formed into box-type which opens one face thereof, and is joined to the substrate 13 so as to block the opening. Accordingly, a common ink chamber 141 for commonly supplying an ink to all the channels 121 in the ink manifold 14 is formed. An ink supplied from an ink flow inlet (not shown) is stored in the common ink chamber 141.

An ink used by setting the internal pressure of a space formed of a later-described damper frame (or a housing) and a flexible film (or a damper wall) at a negative pressure is not particularly restricted, but an ink which is required to be heated up to a predetermined temperature by warming means such as a heater and to reduce an ink viscosity to a viscosity suitable for ejecting an ink is preferably used, such as a gel UV ink and a ceramic ink. In fact, this type of ink is heated in use and can readily generate gas expansion in a later-described damper member, thereby narrowing an ink flow passage leading to an ink inlet 131*a*. Therefore, the internal pressure of a space formed of a later-described damper frame (or a housing) and a flexible film (or a damper wall) is set at a negative pressure at the working temperature to obtain a significant effect.

All the through holes 131 on the substrate 13 open so as to face the common ink chamber 141. Accordingly, each of the through holes 131 composes an individual ink flow passage for supplying an ink in the common ink chamber 141 to a channel 121 between the common ink chamber 141 and the channel 121. An opening of each of the through holes 131 which face the common ink chamber 141 is an ink inlet 131*a* for individually flowing an ink to each of the channels 121. Specifically, an ink inlet in the present invention refers to an opening which individually opens according to each of the pressure chambers connected to a pressure chamber from a surface which faces a common ink chamber.

A damper member 15 of this embodiment is formed into thin box-type, and only one damper member 15 is disposed to bridge across all rows of channels by being placed near the substrate 13 inside of the common ink chamber 141. The damper member 15 comprises a damper chamber 152 inside thereof as shown in FIG. 3. At least one face of a housing 151 is a damper wall 153 formed of a thin flexible film, and an internal space formed of the damper wall 153 and the housing 151 is a damper chamber 152 to seal gas in the damper chamber 152. The type of gas is not particularly restricted. The damper member 15 is disposed so that the damper wall 153 faces the substrate 13. A synthetic resin film can be used for a flexible film composed of the damper wall 153. A polyimide film is preferably used as a synthetic resin film.

The damper member 15 is formed large enough to cover the ink inlet 131*a* of all the through holes 131 formed on the substrate 13 by the damper wall 153. As shown in FIG. 1, when the damper member 15 is projected onto a plane of the substrate 13 from a direction perpendicular to a plane of the substrate 13 having the ink inlet 131*a*, the damper member 15 includes all the ink inlets 131*a*. In this embodiment, the damper member 15 is formed of a rectangular shape in a plane view, but it may be optionally determined such as circular and elliptical if it includes all the ink inlets 131*a*. However, the damper member 15 is formed so as to have a smaller area than an opening area of the ink manifold 14. Thus, as shown in FIG. 2, an ink flow passage 141*a* to the ink inlet 131*a* is provided between the peripheral edge portion of the damper member 15 and an inner wall surface of the common ink chamber 141.

The separation distance between the damper member 15 and the substrate 13 is defined at the shortest distance between a face of the damper member 15 which faces the ink inlet 131*a* of the substrate 13 and the ink inlet 131*a* of a through hole 131 corresponding to the channel 121. Thus, the distance in the damper member 15 is defined at the shortest distance between the damper wall 153 and the ink inlet 131*a*. When the shortest distance is D (FIG. 2) and the distances between the ink inlets 131*a* in the adjacent rows of channels are d1, d2, and d3 (FIG. 4), D<d1, and D<d2, and D<d3 are satisfied. Specifically, the damper member 15 is disposed so that the shortest distance D is shorter than the distances d1, d2, and d3 between the ink inlets 131*a*, 131*a* in adjacent rows of channels. Therefore, the distance between each of the ink inlets 131*a* and the damper wall 153 of the damper member 15 is shorter than the distance between the ink inlet 131*a* and an ink inlet 131*a* in adjacent rows of channels.

As described above, since the damper member 15 is disposed near the substrate 13, a large space is provided between the damper member 15 and a rear inner wall surface 142 of the common ink chamber 141. The rear inner wall surface 142 is an inner wall surface which faces the substrate 13 in the common ink chamber 141. Thus, the common ink chamber 141 can store a sufficient amount of ink by using a space provided with the rear inner wall surface 142 even when the damper member 15 is disposed inside thereof.

Herein, the above shortest distance D is a distance defined at a straight line drawn from each of the ink inlets 131*a* which is orthogonal to the damper wall 153 of the damper member 15. The damper member 15 is disposed so that the shortest distance D is equal as for all the ink inlets 131*a* and the damper wall 153 is parallel to a plane of the substrate 13 on which the ink inlets 131*a* open.

Figure 4:
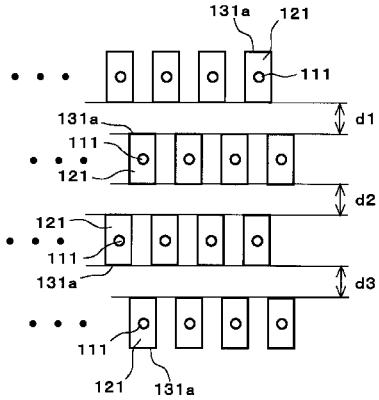
FIG. 4 is a diagram illustrating the distance between ink inlets in adjacent rows of pressure chambers.

In addition, the above distances d1, d2 and d3 are the shortest distance between an ink inlet in one row of channels (ink inlet A) and an ink inlet which is the nearest to the ink inlet A in adjacent rows of channels thereof (ink inlet B). This distance is, as shown in FIG. 4, generally a width of a gap between ink inlets 131*a*, 131*a* in adjacent rows of channels. The distances d1, d2 and d3 may not be the same value.

Next, the operations of the inkjet head 1 will be described.

After the partition wall 122 deforms by applying a predetermined voltage of a driving signal to a driving electrode based on a predetermined printing data, an ejection pressure is imparted to an ink in the channel 121 sandwiched by a pair of the partition walls 122. Thereby the inkjet head 1 ejects an ink droplet from the nozzles 111. A pressure wave generated in the channel 121 comprises not only a component proceeding toward the nozzle 111 but also a component proceeding toward the through hole 131 of the substrate 13. Part of the component proceeding toward the through hole 131 propagates to the common ink chamber 141 through the through hole 131 of the substrate 13. In this case, since the distance between the ink inlet 131*a* and the damper member 15 is shorter than the distance between the ink inlet 131*a* and an ink inlet 131*a* in adjacent rows of channels, a component of the pressure wave propagating from the ink inlet 131*a* to the common ink chamber 141 which goes straight toward the damper member 15 hits on the damper member 15 immediately and is absorbed due to deflection of the damper wall 153 from flexible property of the damper wall 153 and compressive property of gas sealed inside thereof.

Accordingly, the pressure wave propagated to the common ink chamber 141 is reduced before reaching the ink inlet 131*a* in adjacent rows of channels and the impact of crosstalk given to a channel 121 in adjacent rows of channels connected via the common ink chamber 141 can be reduced. In addition, a residual pressure wave in the channel 121 can be reduced. This is because that as the distance for absorbing a pressure wave generated in the channel 121 is shorter, the pressure wave can be reduced in an early stage. Consequently, resulting control of a variation in ejection property can achieve stable ink ejection properties. This effect is caused by just the way of placement of the damper member 15 in the common ink chamber 141. Thus, a member other than the damper member is not required to be provided, e.g. by conventionally forming a narrowed portion by using a partition wall. Therefore, the impact of crosstalk between the rows of pressure chambers arranged in 2 or more rows can be reduced in simplified configuration.

In particular, as shown in this embodiment, since the damper member 15 is disposed so that the damper wall 153 faces each of the ink inlets 131*a*, a pressure wave which goes straight from the ink inlet 131*a* to the damper member 15 directly hits on the damper wall 153. Accordingly, the effect of absorbing the pressure wave is high and the effect of reducing the impact of crosstalk is also high.

An ink in the common ink chamber 141 can have a predetermined temperature by heating when the head chip 12 is heated during drive or heating means such as heater (not shown) is provided. In this case, if a large amount of ink is stored in the common ink chamber 141, the ink easily shows a wide temperature distribution and a variation in ink viscosity can make unstable ink ejection properties according to row of channels or channel 121. Consequently, the speed of ejecting an ink droplet becomes nonuniform and the landing position becomes unstable. However, the damper member 15 is disposed so near the substrate 13, thereby lessening the amount of an ink between the damper member 15 and the ink inlet 131*a*, which can lessen the impact of temperature distribution.

The damper member 15 shown in this embodiment can be configured at a low cost because it is only one which is provided in the common ink chamber 141. One damper member can be disposed according to row of channels, and 2 damper members can be disposed so as to correspond to 2 rows of channels. In the use of a plurality of damper members, if a variation in separation distance to the substrate 13 according damper member is generated, absorption performance of a pressure wave varies. The effect of reducing the impact of crosstalk or the impact of temperature distribution becomes nonuniform between rows of channels corresponding to different damper members. This results in varying the ejection property rather. However, as shown in this embodiment, if one damper member 15 is provided so as to bridge across all the rows of channels, this technical problem can be avoided. Consequently, the effect of reducing the impact of crosstalk and the impact of temperature distribution can be made uniform between rows of channels.

In addition, in this embodiment, since one damper member 15 is disposed so as to coverall the ink inlets 131*a*, a variation in absorption performance of a pressure wave according to channel 121 can be reduced. Accordingly, the effect of reducing the impact of crosstalk or the impact of temperature distribution can be made uniform between the rows of channels 121.

Further, in this embodiment, the distance between each of the ink inlets 131*a* which faces the common ink chamber 141 and the damper wall 153 of the damper member 15 is the same, thereby further reducing the variation in absorption performance of a pressure wave according to each of channels 121. Since the flow path resistance of an ink can be made uniform when the ink is supplied from the common ink chamber 141 to each of the ink inlets 131*a*, the variation in ejection property derived from a variation in the flow path resistance is reduced.

A housing 151 of the damper member 15 preferably contains a metal. The metal may be used on wall surfaces of a part of the housing 151, or form the entire wall surface. Generally, since a metal has a higher thermal conductivity than an ink (liquid), temperature distribution of an ink in the common ink chamber 141 can promptly be made uniform. Thus, while the damper member 15 is placed near the ink inlet 131*a*, a sharp temperature change around the channel 121 can be controlled and the entire temperature distribution can be made uniform.

Illustrative example of the metal has a favorable thermal conductivity, including aluminum, copper and stainless. This type of metal is preferably exposed to a surface of a housing 151 so that it can directly contact with an ink in the common ink chamber 141.

In the inkjet head 1 shown in this embodiment, an ink inlet 131*a*, an ink outlet 121*a* and a nozzle 111 are disposed on a straight line (L) indicated by the dashed line in FIG. 2, and the straight line L intersects the damper member 15. In this configuration, a component of a pressure wave generated in the channel 121 which proceeds to the ink inlet 131*a* can directly be absorbed by the damper member 15, thereby preferably providing the most significant effect of absorbing a pressure wave and a significant effect of reducing the impact of crosstalk.

Since the ink inlet 131*a* opens on the substrate 13, the substrate 13 is disposed so as to face in parallel with the damper member 15 around each of the ink inlets 131*a*. Thus, a component of part of a pressure wave which hits on the damper member 15 may stay in the common ink chamber 141 as a residual by reflecting from the damper member 15 to the substrate 13. In order to prevent a residual component due to a pressure wave reflecting to the substrate 13, a member having a volume elastic modulus of 40 GPa or more is preferably disposed in parallel with the damper member 15 around the ink inlet 131*a*. Accordingly, a pressure wave reflecting on the damper member 15 can be reflected again around the ink inlet 131*a* to the damper member 15, thereby reducing a residual pressure wave in the common ink chamber 141.

A material of this type of member is not particularly restricted if it has a volume elastic modulus of 40 GPa or more, e.g. glass, silicon, metal and a synthetic resin, particularly preferable one is glass which is easy to process, a low-cost material and is not prone to deformation from a pressure wave. This type of member can be disposed between the substrate 13 and the damper member 15 so as to be disposed around the ink inlet 131*a*. However, when the substrate 13 in itself is preferably made of the above material having a volume elastic modulus of 40 GPa or more like glass, it is not necessary to provide an independent member, and the structure can be made more simplified and the cost can be lower.

The internal pressure (air pressure) of the damper member 15 is preferably atmospheric pressure or less when the temperature of an ink in the common ink chamber 141 reaches at the working temperature. This is because expansion of the damper member 15 in use is avoidable, resulting in no increase in flow path resistance of an ink and no decrease in the amount of the ink. The working temperature of an ink refers to a temperature at heating when an ink such as a UV ink and a ceramic ink is used by heating by heating means, or generally the normal temperature (25° C.) when an ink is used by no heating.

The damper member 15 can be produced by attaching a damper wall 153 to one face of a housing 151 at a higher temperature than an ink working temperature, e.g. in an atmosphere at 60° C. and forming a damper chamber 152 having a sealed gas such as air. By disposing the damper member 15 in the common ink chamber 141 at an ink working temperature of 60° C. or less, the damper chamber 152 in use is at atmospheric pressure or less, resulting in no expansion.

Figure 5:
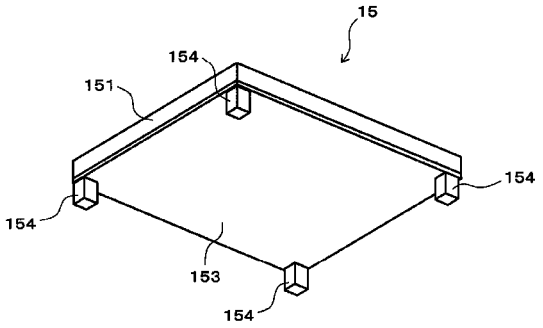
FIG. 5 is a perspective view showing one embodiment of a damper member having projected leg portions.

Means for disposing the damper member 15 at a predetermined distance from the substrate 13 is not particularly restricted. For example, as shown in FIG. 5, an appropriate number of leg portions 154 can be projected on the damper wall 153 which faces the substrate 13. If these leg portions 154 are adhered to the substrate 13, the damper wall 153 of the damper member 15 can readily be disposed at a predetermined separation distance set by the protrusive height of the leg portion 154 from the substrate 13.

The leg portions 154 may be projected onto the substrate 13 in place of the damper member 15.

A support (not shown) may be placed between the damper member 15 and an inner wall surface of the common ink chamber 141 to support the damper member 15 at a predetermined separation distance from the substrate 13.

Herein, a preferred embodiment of the damper member will be described in more detail.

1.

An inkjet head, comprising: pressure chambers arranged in 2 or more rows; a common ink chamber connected to the pressure chambers via an ink inlet for flowing an ink to the pressure chambers; and a damper member in the common ink chamber, the damper member comprising a damper frame and a flexible film, wherein a face which faces at least one of the ink inlets of the damper frame is formed of the flexible film, and the internal pressure of a space formed of the damper frame and the flexible film is a negative pressure at the working temperature.

2.

The inkjet head according to 1, wherein the separation distance between the ink inlet and the flexible film is shorter than the distance between the ink inlet and the ink inlet in rows of the pressure chambers adjacent to the rows including the ink inlet and the pressure chambers connected to the ink inlet.

3.

The inkjet head according to 2, wherein the ratio of the number of the ink inlets disposed so that the separation distance between the ink inlet and the flexible film is shorter than the distance between the ink inlet and the ink inlet in adjacent rows of the pressure chambers in a conveying direction is 90% or more of all the ink inlets.

4.

The inkjet head according to 1 to 3, wherein the working temperature is over 25° C. and 90° C. or less.

5.

The inkjet head according to 1 to 4 or 3, wherein the thickness of the flexible film is 10 μm or more and 150 μm or less.

6.

The inkjet head according to any one of 1 to 5, wherein the internal pressure of a space formed of the damper frame and the flexible film is reduced to 50 kPa or more and under atmospheric pressure at the working temperature.

7.

The inkjet head according to any one of 1 to 6, wherein the damper member includes the ink inlets of all the pressure chambers when the damper member is projected from a direction perpendicular to a plane where the ink inlets are present.

8.

The inkjet head according to any one of 1 to 7, wherein the flexible film of the damper member forms a flat surface or a concave surface when an ink in the common ink chamber is ejected at the working temperature.

9.

The inkjet head according to any one of 1 to 8, wherein at least a part of the damper frame is made of a metal.

10.

An inkjet head, comprising: pressure chambers arranged in 2 or more rows; a common ink chamber connected to the pressure chambers via an ink inlet for flowing an ink to the pressure chambers; and a damper member in the common ink chamber, the damper member comprising a damper frame and a flexible film, wherein a face which faces at least one of the ink inlets of the damper frame is formed of the flexible film, and the damper member is disposed so that the separation distance between the flexible film and the ink inlet is 70 μm or more when an ink in the common ink chamber is ejected at the working temperature.

11.

The inkjet head according to 10, wherein the ratio of the number of the ink inlets corresponding to the damper member so that the separation distance between the damper member and the flexible film is 70 μm or more is 90% or more of all the ink inlets.

12.

The inkjet head according to 10 or 11, wherein the flexible film of the damper member forms a flat surface or a concave surface when an ink in the common ink chamber is ejected at the working temperature.

13.

The inkjet head according to 10, 11 or 12, wherein the flexible film of the damper member forms a flat surface or a concave surface at the normal temperature.

14.

The inkjet head according to any one of 10 to 13, wherein the thickness of the flexible film is 50 μm or more and 150 μm or less.

15.

An inkjet head, wherein an ink used in the inkjet head according to any one of 1 to 14 is a UV ink, a gel UV ink or a ceramic ink.

16.

An inkjet head, wherein the gel UV ink according to 15 contains at least 0.3 to 15% by mass of an oil gelatification agent relative to all mass of an ink and an active ray-curable composition which cures by an active ray.

17.

An inkjet recording apparatus, comprising: the inkjet head according to any one of 1 to 16; a conveying portion for conveying a recording medium; and an inkjet head attaching member for attaching the inkjet head so that the inkjet head faces the conveying portion.

18.

The inkjet recording apparatus according to 17, comprising irradiation means for curing an ink droplet ejected from the inkjet head.

19.

A method for producing a damper member, the damper member being included in an inkjet head, the inkjet head comprising: pressure chambers arranged in 2 or more rows; a common ink chamber connected to the pressure chambers via an ink inlet for flowing an ink to the pressure chambers; and a damper member in the common ink chamber, the damper member comprising a damper frame and a flexible film, wherein a face which faces at least one of the ink inlets of the damper frame is formed of the flexible film, and the method for producing a damper member comprising a negative pressure forming step for setting the internal pressure of a space formed of the damper frame and the flexible film at a negative pressure.

16.

The method for producing a damper member according to 15, wherein the negative pressure forming step set the internal pressure of a space formed of the damper frame and the flexible film at a negative pressure by laminating the flexible films to the damper frame in a depressurization chamber at a predetermined pressure.

17.

The method for producing a damper member according to 15, wherein the negative pressure forming step sets the internal pressure of a space at a negative pressure by inserting a hollow pipe member into an adhesive layer after laminating the flexible films to the damper frame via the adhesive layer and drawing an internal gas of a space formed of the damper frame and the flexible film through the pipe member.

The above preferred embodiment can provide an inkjet head which is provided with a damper member having a damper effect which never narrows an ink flow passage after a damper surface protrudes in a direction of pressure chambers.

In addition, the above preferred embodiment can provide a method for producing a damper member capable of readily producing a damper member which is provided with a damper effect which never narrows an ink flow passage after a damper surface protrudes in a direction of pressure chambers.

The damper member will be described with reference to the drawings, but description overlaps with the above description is included.

The damper member 15 is disposed so as to come near the substrate 13 inside of the common ink chamber 141. The damper member 15 comprises, as shown in FIG. 3, a damper frame 151 and a flexible film 153 which functions as a damper surface. In the following description, one damper member 15 is disposed inside of the common ink chamber 141, but the damper member is not restricted to only one and a plurality of damper members 15 may be disposed. For example, a plurality of damper members corresponding to ink inlets 131*a* may be disposed.

The damper frame 151 is formed of a thin box type of a rigid member whose face on the flexible film 153 opens. The face on which the flexible film 153 is formed may be present on at least a face which faces the ink inlet 131*a*. Herein, only a hexahedron face which faces the ink inlet 131*a* opens and a damper frame 151 on which the face is formed of the flexible film 153 is illustrated. The damper member 15 may have 2 or more faces on which a flexible film is formed.

At least a part of the damper frame 151 is preferably made of a metal. The metal may be used on wall surfaces of a part of the damper frame 151, or may form all the wall surfaces. Since a metal generally has a higher thermal conductivity than an ink (liquid), temperature distribution of an ink in the common ink chamber 141 can promptly be made uniform.

Illustrative example of the metal preferably includes ones having favorable thermal conductivity such as aluminum, copper and stainless. This type of metal is preferably exposed on a surface of the damper frame 151 so as to directly contact with an ink in the common ink chamber 141.

The flexible film 153 is attached to block a face which opens on the damper frame 151. The damper chamber 152 is configured from an internal space formed of the damper frame 151 and the flexible film 153. A gas such as air is sealed in the damper chamber 152. In the present invention, the internal pressure of the damper chamber 152 is set at a negative pressure at the working temperature, or the damper member 15 is disposed so that the shortest separation distance between the flexible film 153 and the ink inlet 131*a* is 70 μm or more when an ink is ejected at the working temperature. Accordingly, while the damper member 15 exerts a damper effect, the damper member 15 never narrows an ink flow passage after a damper surface protrudes in a direction of pressure chambers.

Firstly, the case of setting the internal pressure of the damper chamber 152 at a negative pressure will be described in detail.

The internal pressure of the damper chamber 152 in the damper member 15 will be described. A negative pressure of the damper chamber 152 refers to a negative internal pressure of the damper member 15 at the working temperature compared to atmospheric pressure.

Thus, since the damper chamber 152 in the damper member 15 is set at a negative pressure, protrusion of the flexible film 153 to the ink inlet 131*a* can be avoided when an ink in the common ink chamber 141 is heated up to the working temperature to expand a gas in the damper chamber 152. Therefore, even during drive of the inkjet head 1, as shown in FIG. 2, an ink flow passage 141*b* for flowing an ink can be provided at each ink inlet 131*a* between the flexible film 153 of the damper member 15 and the substrate 13. The damper member 15 doesn't obstruct the flow of the ink to each channel 121. Specifically, the damper member 15 provides a damper effect even during high temperature use of an ink, and the flexible film 153 as a damper surface doesn't narrow an ink flow passage by protruding in direction of the channel 121.

A specific pressure of the damper chamber 152 in the damper member 15 is not particularly restricted if it is a negative pressure with a gas sealed inside as stated above. If the pressure is reduced to 50 kPa or more and under atmospheric pressure at the working temperature and at one atmosphere, a damper effect is provided and the effect of the flexible film 153 to cause no narrowing of an ink flow passage are preferably produced. As a method for confirming the above-described negative pressure, the damper member is taken out of the common ink chamber (preferably at one atmosphere). If the internal pressure of the damper member shows a negative pressure at the working temperature, the internal pressure can be confirmed as negative.

Illustrative example of a method for measuring the pressure of the damper chamber 152 in the damper member 15 includes various methods including the following one.

A thin tube such as a syringe needle is attached to the tip of a pressure gauge, and the thin tube is inserted into the flexible film 153 of the damper member 15 so that an internal gas doesn't leak to connect the inside of the tube to the inside of the damper chamber 152. The pressure of a gas passing inside of the tube and acting on a pressure gauge is directly measured. According to this method, even when the differential pressure between the atmospheric pressure and the internal pressure of the damper chamber 152 is small, the internal pressure can precisely be measured by a pressure gauge. When the above-described thin tube is inserted into the flexible film 153 of the damper member 15, the flexible film 153 can come apart, thereby causing leakage of the internal gas. Then, after a resin adhesive or the like is provided in advance on the flexible film 153 so as to surround the location to be inserted, the above-described thin tube is inserted there. Thereby the fracture of the flexible film 153 is reduced.

Next, the case of disposing the damper member 15 at the working temperature for ejecting an ink so that the shortest separation distance between the flexible film 153 and the ink inlet is 70 μm or more will be described.

In order to favorably supply an ink from the common ink chamber 141 to the ink inlet 131*a*, the damper member 15 is disposed so that the shortest separation distance D (FIG. 2) between at least one of the ink inlets 131*a* and the flexible film 153 of the damper member 15 is 70 μm or more at the working temperature for ejecting an ink. According to the above-described configuration, an ink in the common ink chamber 141 is heated up to the working temperature to expand a gas in the damper chamber 152. In this case, even when the flexible film 153 protrudes to the ink inlet 131*a*, the shortest separation distance D between at least one of the ink inlets 131*a* and the flexible film 153 of the damper member 15 (FIG. 2) can be set at 70 μm or more. Thus, even during drive of the inkjet head 1, as shown in FIG. 2, an ink flow passage 141*b* for flowing an ink into each of the ink inlets 131*a* can be provided between the flexible film 153 of the damper member 15 and the substrate 13. Accordingly, even when an ink is used at a high temperature, the damper member 15 doesn't obstruct the flow of the ink to each channel 121.

The working temperature for ejecting an ink is a temperature of an ink in the common ink chamber 141 when the ink is ejected from the nozzles 111, which is higher than the normal temperature (25° C.). Illustrative example of the means (not shown) for setting the temperature of an ink in the common ink chamber 141 at the working temperature includes means for providing a heater on a surface of the manifold 14 or in the common ink chamber 141 to directly heat the ink in the common ink chamber 141, means for heating an ink in an ink tank by a heater to supply the ink heated in the ink tank to the common ink chamber 141, means for providing a heater to a supply tube for supplying an ink to the inkjet head 1 to supply the ink supplied and heated to the common ink chamber 141, or a combination of 2 or more thereof.

Without any means for heating an ink as described above, the inkjet head 1 is heated due to drive of a piezoelectric element, thereby the ink is heated. Accordingly, the ink in the common ink chamber 141 is heated to the working temperature by heating of the piezoelectric element.

A synthetic resin film can be used for the flexible film 153. Illustrative example of the synthetic resin includes PI (polyimide), LCP (liquid crystal polymer), PET (polyethylene terephthalate), PE (polyethylene) and PP (polypropylene). The thickness of the flexible film 153 should be determined to prevent narrowing of an ink flow passage from expansion of a gas in the damper chamber 152. Specifically, while a film comprising a damper surface is made thicker to control the amount of protrusion during expansion, this method can damage a damper effect from resulting decline in efficiency of pressure wave damping. Consequently, the thickness is not particularly restricted, but preferably 50 μm or more and 150 μm or less to effectively provide a damper effect by using the flexible film 153.

The damper member 15 is disposed in the common ink chamber 141 so that a face to which the flexible film 153 is attached faces the substrate 13. Accordingly, the flexible film 153 of the damper member 15 is opposed to the ink inlet 131*a* of the through hole 131 which opens on the substrate 13.

A plane of the damper member 15 is formed of a rectangular shape, but it may optionally be a circular, an elliptical, or a polygonal shape. The size of the damper member 15 is smaller than the opening area of the ink manifold 14. As shown in FIG. 2, an ink flow passage 141*a* to the ink inlet 131*a* is formed between the peripheral edge portion of the damper member 15 and an inner wall surface of the common ink chamber 141.

In cases where the internal pressure of the damper chamber 152 is set at a negative pressure at the working temperature, or the damper member 15 is disposed so that the shortest separation distance D between the flexible film 153 and the ink inlet 131*a* is 70 μm or more at the working temperature for ejecting an ink, an ink flow passage 141*b* for flowing an ink into each of the ink inlets 131*a* is provided between the flexible film 153 of the damper member 15 and the substrate 13 to favorably prevent obstruction of flow of an ink into each channel 121 by the damper member 15. In this view, the flexible film 153 of the damper member 15 preferably forms a flat surface, or a concave surface in a direction opposite to the ink inlet 131*a* at the working temperature for ejecting an ink in the common ink chamber 141. In addition, for the damper member 15 to favorably prevent obstruction of flow of an ink to each channels 121, the flexible film 153 of the damper member 15 preferably forms a flat surface, or a concave surface in a direction opposite to the ink inlet 131*a* at the normal temperature (25° C.).

The damper member 15 is more preferably disposed so that the separation distance D between at least one of the ink inlets 131*a* and the flexible film 153 of the damper member 15 in the common ink chamber 141 is shorter than the distance between the ink inlet 131*a* and an ink inlet 131*a* in rows of channels adjacent to the rows of channels including the channels 121 connected to the ink inlet 131*a*. The rows of channels adjacent to the rows refer to adjacent rows of channels in Y direction in FIG. 1.

The separation distance D refers to a vertical distance from the ink inlet 131*a* to the flexible film 153 of the damper member 15. The separation distance D preferably satisfies D<d1, D<d2 and D<d3, where the distances between the ink inlets 131*a* in adjacent rows of channels in a conveying direction are d1, d2 and d3 (FIG. 4).

Specifically, the damper member 15 is preferably disposed in the common ink chamber 141 so that the separation distance D is shorter than the distance d1, d2 and d3 between the ink inlets 131*a*, 131*a* of adjacent rows of channels. In this case, the distance between the ink inlet 131*a* and the flexible film 153 of the damper member 15 is shorter than the distance between the ink inlet 131*a* and an ink inlet 131*a* in adjacent rows of channels.

The above-described distances d1, d2 and d3 are the shortest distance between an ink inlet in one row of channels (ink inlet A) and an ink inlet which is the nearest to the ink inlet A in adjacent rows of channels thereof (ink inlet B). The distance is, as shown in FIG. 4, generally a width of a gap formed between ink inlets A and B in adjacent rows of channels. The distances d1, d2 and d3 may not be the same value.

Accordingly, since the damper member 15 is disposed in the common ink chamber 141, a component of a pressure wave which passes through the ink inlet 131*a* from the channel 121 to be propagated to the common ink chamber 141 and goes straight toward the damper member 15 can promptly be hit on the flexible film 153 to provide a damper effect. The pressure wave which hits on the flexible film 153 will be absorbed after the flexible film 153 is deflected from compression of a gas sealed in the damper chamber 152. In this case, the direct distance between the ink inlet 131*a* and the flexible film 153 defined by the separation distance D is shorter than the distance between the ink inlet 131*a* and an ink inlet 131*a* in adjacent rows of channels. Therefore, a pressure wave which is propagated from the ink inlet 131*a* to the common ink chamber 141 is absorbed by the flexible film 153 before reaching the ink inlet 131*a* in adjacent rows of channels.

Consequently, the damper member 15 absorbs and reduces a pressure wave which is propagated from the ink inlet 131*a* to the common ink chamber 141 before reaching the ink inlet 131*a* in adjacent rows of channels, and can reduce the impact of crosstalk which is imparted to adjacent rows of channels 121 connected via the common ink chamber 141.

In the inkjet head 1 shown in this embodiment, an ink inlet 131*a*, an ink outlet 121*a* and a nozzle 111 are disposed on a dashed straight line L in FIG. 2, and the straight line L intersects the damper member 15. According to the configuration, a component of a pressure wave generated in the channel 121 which proceeds toward the ink inlet 131*a* can directly be absorbed by the damper member 15, thereby preferably providing the most positive effect of the pressure wave to absorb the pressure wave and an effect of reducing the impact of crosstalk.

Means for disposing the damper member 15 at a predetermined separation distance D from the ink inlet 131*a* is not particularly restricted. As shown in FIG. 5, for example, an appropriate number of leg portions 154 are projected onto a face on the flexible film 153 of the damper member 15. If the leg portions 154 are abutted against the substrate 13, the separation distance D can readily be defined by protrusive height of the leg portions 154. The leg portions may be provided on a lateral face of the damper frame 151 or may be projected onto the substrate 13.

In addition, a support (not shown) may be placed between the damper member 15 and an inner wall surface of the common ink chamber 141 to support the damper member 15 at a predetermined separation distance D from the substrate 13.

The damper member 15 shown in this embodiment is formed large enough to cover ink inlets 131*a* of all the through holes 131 on the substrate 13 by the flexible film 153. Specifically, as shown in FIG. 1, when the damper member 15 is projected onto a surface 13*a* of the substrate 13 from a direction perpendicular to the surface 13*a* on which an ink inlet 131*a* is present, the damper member 15 includes all the ink inlets 131*a*. Accordingly, a pressure wave from all the channels 121 can be damped by the damper member 15. Moreover, a variation in absorption performance of a pressure wave according to channel 121 can be reduced. Thus, the effect of reducing the impact of crosstalk and the impact of temperature distribution can be made uniform between the channels 121 in this preferred embodiment.

In cases where the damper member 15 can include the flexible film 153 as a flat surface, the damper member 15 can more preferably provide a uniform damper effect relative to all the channels 121 if it is parallel to the surface 13*a* of the substrate 13.

However, in the present invention, if the damper member 15 is disposed so that the separation distance D between at least one of the ink inlets 131*a* and the flexible film 153 is shorter than the distance between the ink inlet 131*a* and an ink inlet 131*a* in rows of channels adjacent to the rows including the channels 121 connected to the ink inlet, a pressure wave from the ink inlet 131*a* can be damped by a damper effect to reduce the impact of crosstalk which is imparted to adjacent rows of channels 121.

Obviously, the number of the ink inlets 131*a* for damping a pressure wave by the damper member 15 before the pressure wave reaches adjacent rows of the ink inlets 131*a* is preferably larger. Specifically, the damper member 15 is preferably disposed so that the ratio of the number of ink inlets 131*a* disposed so that the separation distance D between the ink inlet 131*a* and the flexible film 153 of the damper member is shorter than the distance between the ink inlet 131*a* and an ink inlet 131*a* in adjacent rows of channels is 90% or more of all the ink inlets 131*a* in view of reduction in the impact of crosstalk.

In cases where the flexible film 153 of the damper member 15 forms a concave curved surface at the working temperature for ejecting an ink, the separation distance D between the ink inlet 131*a* and the flexible film 153 is preferably defined as the distance between the most concave portion of the flexible film 153 and an ink inlet 131*a* which is the nearest thereto. Accordingly, the distance between the flexible film 153 and any ink inlet 131*a* is shorter than the distance between the ink inlet 131*a* and an ink inlet 131*a* in adjacent rows of channels to assuredly obtain an effect of reducing the impact of crosstalk between adjacent rows of channels.

(Method for Producing a Damper Member)

Subsequently, one example of a method for producing a damper member 15 in which the internal pressure is set at a negative pressure will be described.

The damper member 15 is produced by means of a negative pressure forming step for setting the internal pressure inside of the damper chamber 152 formed of the damper frame 151 and the flexible film 153 at a negative pressure.

Figure 9:
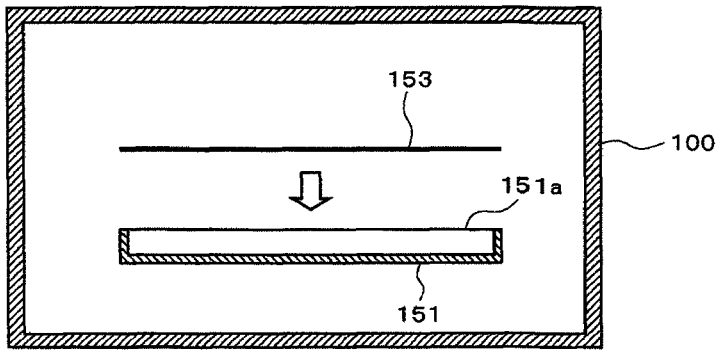
FIG. 9 is a diagram illustrating one example of a method for producing a damper member.

Illustrative example of the negative pressure forming step includes, as shown in FIG. 9, a step for laminating the damper frame 151 and a flat flexible film 153 in a depressurization chamber 100 while the internal pressure is reduced at a predetermined pressure (a target pressure of the damper chamber 152).

Specifically, in a depressurization chamber 100 in which a pressure is reduced to a predetermined pressure, flexible films 153 are laminated on an opening surface 151*a* of the damper frame 151 so as to block the opening surface 151*a*. Accordingly, a gas whose pressure is reduced in a depressurization chamber 100 is sealed in a damper chamber 152 formed of the damper frame 151 and the flexible film 153 to obtain a damper member 15 with the internal pressure as a negative pressure.

The flexible films 153 can be laminated by using an adhesive or a double-sided tape. When the flexible films 153 are adhered with an adhesive, the adhesive is cured under reduced pressure in the depressurization chamber 100. When the flexible films 153 are adhered with a double-sided tape, they may be taken out of the depressurization chamber 100 after laminating the same.

Since the damper member 15, when taken out of the depressurization chamber 100 under atmospheric pressure shows a negative pressure of the damper chamber 152, the flexible film 153 forms a concave curved surface. After this damper member 15 is disposed in the common ink chamber 141 of the inkjet head 1, an ink in the common ink chamber 141 is heated up to the working temperature. As a result, a gas in the damper chamber 152 is expanded. The flexible film 153 after expansion protrudes according to the extent of a negative pressure of the damper chamber 152 and the extent of flexibility of the flexible film 153, and forms a flat surface or a concave curved surface.

According to this method, a damper member whose damper chamber 152 is subjected to a predetermined negative pressure can readily be produced. Since the pressure in the depressurization chamber 100 is set at a negative pressure, uniform damper members 15 can be produced in large quantities with no variation in pressure in the damper chamber 152.

The negative pressure forming step can be performed under atmospheric pressure without using a depressurization chamber 100 as described above.

For example, not shown, after an adhesive is applied on a peripheral edge portion of the opening surface 151*a* of the damper frame 151 to form an adhesive layer, the flexible films 153 are laminated. Thereafter, before the adhesive layer is cured, a hollow fine pipe member such as a syringe needle is inserted into the adhesive layer between the damper frame 151 and the flexible film 153, and an internal gas of a space formed of the damper frame 151 and the flexible film 153 is drawn via a pipe member by using appropriate pressure reducing means such as a syringe and a suction pump. Accordingly, the damper chamber 152 can be put into a negative pressure. After a predetermined amount of gas is drawn to take out a pipe member, a procured adhesive layer will flow to block a hole by a pipe member, and a negative-pressure gas is sealed in the damper chamber 152.

The method can more readily produce a damper member without any large equipment such as a depressurization chamber.

(Second Embodiment of Inkjet Head)

Figure 6:
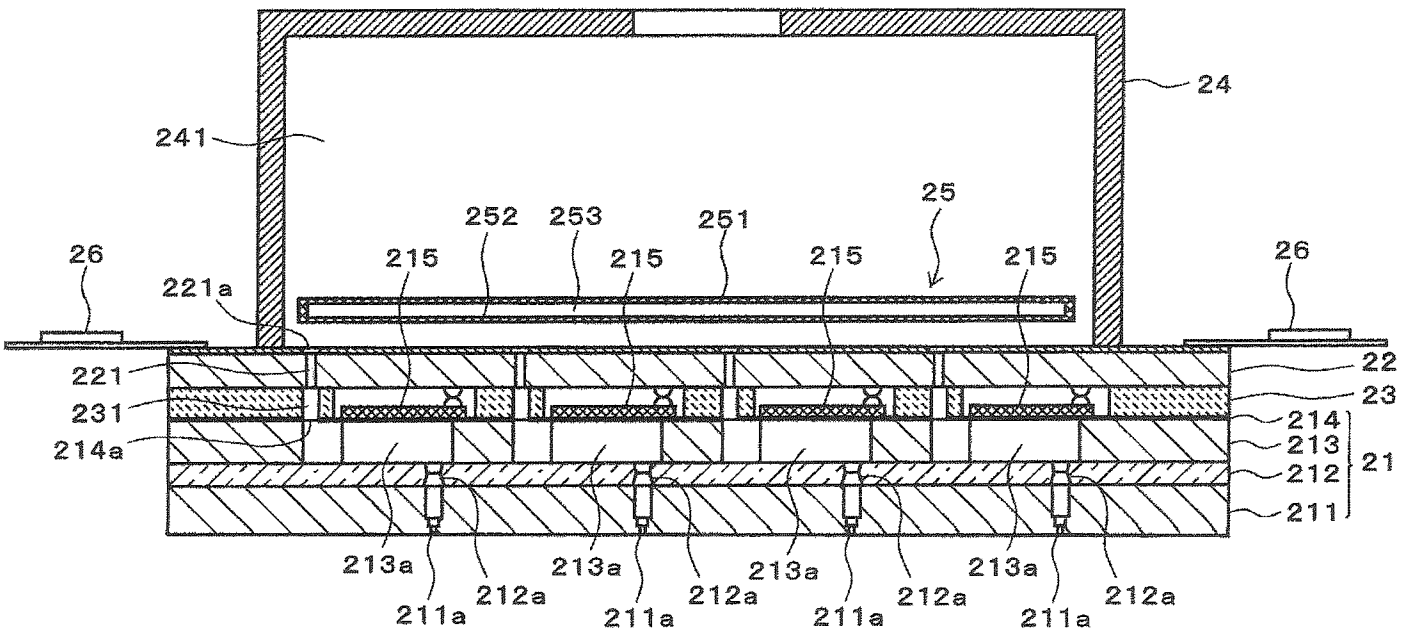
FIG. 6 is a cross-sectional view showing a second embodiment of an inkjet head according to the present invention.

FIG. 6 is a cross-sectional view showing a second embodiment of an inkjet head according to the present invention.

The inkjet head 2 is composed of a head substrate 21 and a wiring substrate 22 integrally laminated by an adhesive resin layer 23. An ink manifold 24 formed of a box type is joined to an upper surface of the wiring substrate 22 to form a common ink chamber 241 for storing an ink inside with the wiring substrate 22. A damper member 25 is disposed in the common ink chamber 241.

The head substrate 21 comprises a nozzle plate 211 formed of an Si (silicon) substrate, an intermediate plate 212 formed of a glass substrate, a pressure chamber plate 213 formed of an Si (silicon) substrate and a diaphragm 214 formed of an $SiO_2$ thin film arranged from a lower layer in the figure. A nozzle 211*a* opens on a lower surface of the nozzle plate 211.

A pressure chamber 213*a* for containing an ink is formed in the pressure chamber plate 213. An upper wall thereof is configured by the diaphragm 214, and a lower wall thereof is configured by the intermediate plate 212. A communicating path 212*a* for connecting the inside of the pressure chamber 213*a* and the nozzle 211*a* is formed in the intermediate plate 212 so as to penetrate therethrough.

Actuators 215 are laminated on an upper surface of the diaphragm 214 corresponding to each pressure chambers 213*a*. In each actuator 215, an actuator body composed of a piezoelectric element such as a thin film PZT is sandwiched by an upper electrode and a lower electrode, each serving as a driving electrode, and the lower electrode is disposed on the upper surface of the diaphragm 214.

The wiring substrate 22 is a substrate which has wiring for applying a predetermined voltage of a driving signal to each actuators 215, and an external wiring member 26 such as FPC is electrically connected to an end thereof by an anisotropic conductive film (ACF).

The adhesive resin layer 23 is formed of e.g. a thermosetting photosensitive adhesive resin sheet, and by placing the same between the head substrate 21 and the wiring substrate 22, both substrates 21, 22 are integrally laminated. The adhesive resin layer 23 provides a space between the both substrates 21, 22 by a thickness of the adhesive resin layer 23. In the adhesive resin layer 23, a region corresponding to the actuator 215 and a peripheral edge portion thereof is removed by exposure and development. Each of the actuators 215 is contained in a space in which the adhesive resin layer 23 is removed.

In the adhesive resin layer 23, through holes 231 which are vertically penetrated are formed according to the number of pressure chambers 213*a*. One end (upper end) of each of the through holes 231 is connected to the ink supply channel 221 formed at the wiring substrate 22, and the other end (lower end) thereof is connected to the inside of the pressure chamber 213*a* via the opening 214*a* formed at the diaphragm 214. The ink supply channel 221 opens on an upper surface of the wiring substrate 22. The opening faces in the common ink chamber 241 and functions as an ink inlet 221*a* for supplying an ink in the common ink chamber 241 to each of the pressure chambers 213*a*.

In the inkjet head 2, an ink is supplied from the common ink chamber 241 to the pressure chamber 213*a* via the ink inlet 221*a*. When a drive signal is applied from the external wiring member 26 to the actuator 215, the diaphragm 214 is vibrated from deformation of the actuator 215. A change in pressure for ejecting an ink into the pressure chamber 213*a* is imparted to eject the ink in the pressure chamber 213*a* from the nozzle 211*a* via the communicating path 212*a*.

The inkjet head 2, not shown, comprises one row of pressure chambers 213*a* by arranging a plurality of pressure chambers 213*a* side by side, and the inkjet head 2 comprises a plurality of rows of pressure chambers 213*a* by arranging a plurality thereof, and 3 or more rows of pressure chambers 213*a* are preferably provided. Thus, an ink inlet 221*a* corresponding to each row of pressure chambers 213*a* faces in the common ink chamber 241. The damper member 25 is disposed so that like the damper member 15 in the first embodiment, the shortest distance between the damper member and the ink inlet 221*a* is shorter than the distance between the ink inlets 221*a*, 221*a* in rows of adjacent pressure chambers 213*a*. The damper member 25 comprises a damper chamber 253 having a sealed gas inside thereof. The damper member 25 further comprises a damper frame 251 and a flexible film 252, and forms a damper chamber 253 by the inside of a space formed of the damper frame 251 and the flexible film 252. The pressure in the damper chamber 253 is set at a negative pressure. Other specific configurations of the damper member 25 are the same as the above-described damper member 15, so they will be described in detail with reference to the descriptions of the damper member 15 in the first embodiment.

In the inkjet head 2 as well, the actuator 215 is operated to generate a pressure wave in the pressure chamber 213*a*. Part of the pressure wave slightly damps from the pressure chamber 213*a* to the through hole 231 and the ink supply channel 221 by narrowing of a flow passage, but it is propagated from the ink inlet 221*a* to the common ink chamber 241. However, before the pressure wave which is propagated to the common ink chamber 241 reaches an ink inlet 221*a* in adjacent rows, the pressure wave can be absorbed by the damper member 25 to reduce the impact of crosstalk by the pressure wave to adjacent rows of pressure chambers 213*a*, resulting in the same damper effect as in the first embodiment.

In addition, the damper member 25 can be disposed, like the above-described damper member 15, so that the separation distance between at least one of ink inlets 221*a* and the flexible film 252 is shorter than the distance between the ink inlet 131*a* and an ink inlet 131*a* in rows of the channels 121 adjacent to the rows including the channels 121 connected to the ink inlet 131*a*.

The damper member 25 can also be disposed, like the above-described damper member 15, so that the separation distance between the flexible film 252 and the ink inlet 221*a* is 70 μm or more at the working temperature for ejecting the ink in the common ink chamber 241.

In the inkjet head 2 as well, an actuator 215 is operated to generate a pressure wave in the pressure chamber 213*a*. Part of the pressure wave is propagated from the ink inlet 221*a* to the common ink chamber 241. However, before the pressure wave which is propagated to the common ink chamber 241 reaches an ink inlet 221*a* in adjacent rows, the pressure wave can be absorbed by the damper member 25 to reduce the impact of crosstalk by the pressure wave to adjacent rows of pressure chambers 213*a*. In this case, the pressure of the damper chamber 253 in the damper member 25 is a negative pressure at the working temperature, thereby obtaining, like the inkjet head 1 in the first embodiment, a damper effect while using a high-temperature ink, and an effect of no narrowing of an ink flow passage after the flexible film 252 protrudes in a direction of the pressure chamber 213*a* can be provided.

Configurations regarding ways the damper member 25 is disposed and configured are the same as the damper member 15 described in the first embodiment. They will be described in detail with reference to the descriptions of the damper member 15 in the first embodiment.

(Other Embodiments of Inkjet Head)

As described above, a preferred embodiment in which damper members 15, 25 are formed of damper walls (flexible films) 153, 252 composed of a flexible film on a wall surface of housings (damper frames) 151, 251 is illustrated, but it is not restricted thereto. A pack-shaped damper member having a sealed gas inside by sealing a peripheral edge portion of two flexible films may be introduced.

Since damper members 15, 25 having a sealed gas have the highest effect of absorbing a pressure wave, they can preferably be used in the present invention. The damper members may have an effect of absorbing a pressure wave, and not always restricted to the one having a sealed gas inside thereof, e.g. may be the one in which at least a wall surface which faces an ink inlet (not shown) is composed of a plate member formed of a material having a volume elastic modulus of 40 GPa or less. The damper members are formed of a solid shape inside and a gas is not sealed. Use of the damper members can delay reflection of a pressure wave and absorb part thereof when a pressure wave which is propagated to the common ink chamber hits on wall surfaces which face an ink inlet of a damper member. Accordingly, like the damper members 15, 25, an effect of reducing the impact of crosstalk between rows can be provided.

Preferred illustrative example of the material having a volume elastic modulus of 40 GPa or less includes a flexible synthetic resin. Illustrative example of the flexible synthetic resin used for this intended purpose includes polyetherimide, liquid crystal polymer, polyphenylene ether, polyamide, polyphenylene sulfide, polyimide and unsaturated polyester.

An inkjet recording apparatus by using the inkjet heads of the embodiments according to the present invention will be described.

The inkjet recording apparatus comprises an inkjet head, a head attaching member and a conveying portion.

The inkjet head is attached to the head attaching member so as to face in opposite to the conveying portion. The conveying portion preferably comprises a conveying belt and a drive portion for moving the conveying belt. By drive of the drive portion, a recording medium placed on a conveying belt is preferably conveyed to an image forming region for ejecting an ink from an inkjet head to form an image. Obviously, such configurations as forming an image by scanning a head in a direction orthogonal to a conveying direction and conveying a recording medium by placing a recording medium as a conveying portion and rotating the same are favorable.

When an ink such as a UV ink or a gel UV ink is used as an ink used for an inkjet head, irradiation means for curing the ink after forming an image by ejecting the ink from the inkjet head to the recording medium is preferably provided in the inkjet recording apparatus.

The irradiation means preferably comprises a light source such as an ultraviolet lamp which emits an ultraviolet ray of a specific wavelength region by stable exposure energy and a filter which transmits a specific wavelength of an ultraviolet ray.

Herein, illustrative example of the ultraviolet lamp includes a mercury lamp, a metal halide lamp, an excimer laser, an ultraviolet laser, a cold-cathode tube, a hot-cathode tube, a black light and an LED (light emitting diode). A strip-shaped metal halide lamp, a cold-cathode tube, a hot-cathode tube, a mercury lamp or a black light is preferable, and an LED is more preferable in view of longer life and inexpensive product.

Next, an ink used in the inkjet heads of the embodiments according to the present invention will be described in detail.

Various types of inks, such as a UV ink, a gel UV ink and a ceramic ink, can be used for the inkjet heads of the present invention. Even during high-speed printing, a gel UV ink is more preferable to prevent printed image peeling and achieve high-quality images.

A gel UV ink contains an active ray-curable composition which cures by an active ray such as an oil gelatification agent and UV light. The above-described gel refers to a solidified or semi-solidified state associated with a sharp increase in viscosity and a significant increase in elasticity having a structure in which a solute aggregates by losing an independent mobility due to interaction of a lamellar structure, a polymer network having covalent bond or hydrogen bond, a polymer network formed of physical aggregation and an aggregated structure of a microparticle.

The above-described oil is a collective term for a non-water compound, and the above-described oil gelatification agent refers to a compound which can form the gel when the oil gelatification agent is added to the non-water compound.

Generally, gels are classified into a heat reversible gel which becomes a mobile solution by heating (called as "sol") and returns to the original gel by cooling and a heat irreversible gel which doesn't return to the original solution again even by heating once it is gelatinized. A gel formed by an oil gelatification agent is preferably a heat reversible gel.

As for a gel UV ink, the phase transition temperature is preferably 40° C. or more and 80° C. or less, more preferably 45° C. or more and 70° C. or less. If the phase transition temperature is 40° C. or more, stable ink ejection properties can be obtained without any impact by printing temperature when an ink droplet is ejected from a record head. If the temperature is 80° C. or less, it is not necessary to heat the inkjet recording apparatus excessively, and the load on the head of an inkjet recording apparatus and a member of an ink supply member can be reduced.

To provide the phase transition temperature of an ink defined above, the melting point of an oil gelatification agent used is preferably 20 to 250° C., more preferably 40 to 90° C.

The phase transition temperature by sol-gel in the present invention refers to a temperature at which the phase turns to a gel from a mobile solution by a sharp change in viscosity, and is also understood as gel transition temperature, gel melting temperature, gel softening temperature, sol-gel phase transition temperature and gel point.

Illustrative example of the oil gelatification agent may include a polymer or a small molecule compound, but preferably a small molecule compound to be used for an ink. Preferred illustrative example of the gel structure includes a compound with which an oil gelatification agent itself can forma fibrous aggregate. Formation of a fibrous aggregate can readily be confirmed by morphological observation by using a transmission electron microscope.

Illustrative example of the oil gelatification agent which can be used for an ink in the present invention will be described, but the present invention is not solely restricted to these compounds.

[Formula 1]

(※1)

OG-1

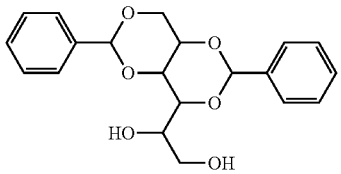

OG-2

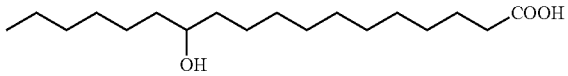

OG-3

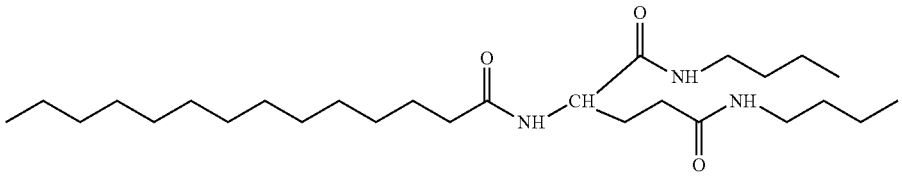

OG-4

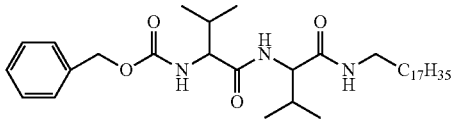

OG-5

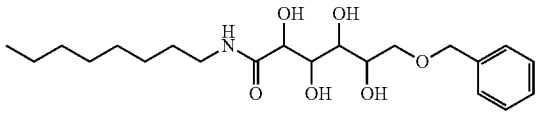

OG-6

$F(CF_2)_n(CH_2)_mH$

OG-7

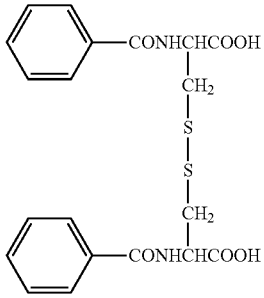

OG-8

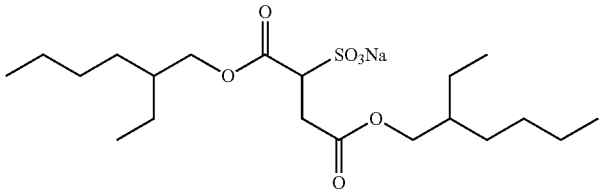

[Formula 2]

(※2)

OG-9

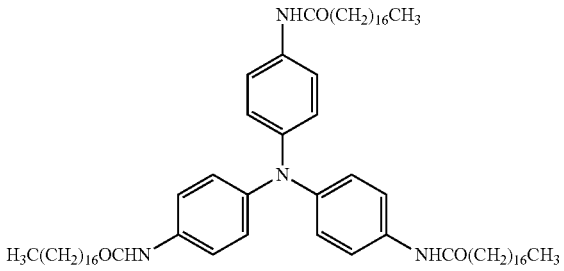

OG-10

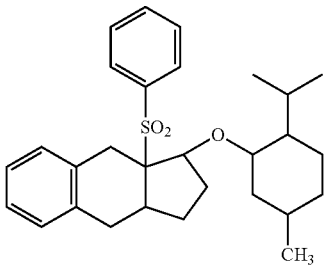

-continued

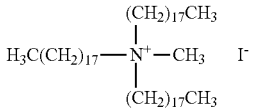

OG-11

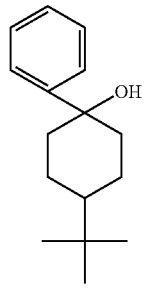

OG-12

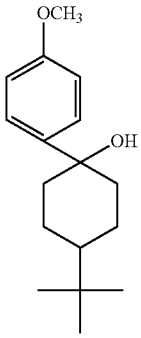

OG-13

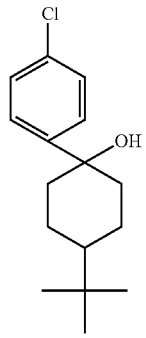

OG-14

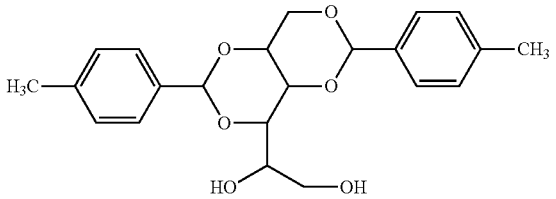

OG-15

A preferred compound used in the above-described oil gelatification agent includes OG-1, OG-2, OG-5 and OG-15. The content of an oil gelatification agent may be 0.3 to 15% by mass relative to the total mass of an ink, particularly preferably 3 to 15% by mass. If the content of an oil gelatification agent is in the range of 0.3 to 15% by mass, more stable ink ejection properties can be obtained and a target effect of the present invention can further be provided. In cases where a pigment is used as a color material in particular, the effective content of an oil gelatification agent is in the range of 0.3 to 15% by mass because the oil gelatification agent can damage decentralized stabilization of a pigment.

A photopolymerizable compound as an active ray-curable composition contained in a UV ink can be used in an unrestricted manner, and among other things, an optical cation polymerizable compound or a radically polymerizable compound is preferably used.

A conventionally known cation polymerizable monomer can be used as an optical cation polymerizable monomer, e.g. an epoxy compound, a vinyl ether compound and an oxetane compound illustrated in the publications of JP-A-6-9714, JP-A-2001-31892, JP-A-2001-40068, JP-A-2001-55507, JP-A-2001-310938, JP-A-2001-310937 and JP-A-2001-220526.

Illustrative example of the radically polymerizable compound includes a photocurable material by using a photopolymerizable composition disclosed in the publications of JP-A-7-159983, JA-A-7-31399, JP-A-8-224982 and JP-A-10-863 and a cation polymerizable photocurable resin, and a cation polymerizable photocurable resin sensitized in a long wavelength range of a visible light or more has recently been disclosed in the publications of JP-A-6-43633 and JP-A-8-324137.

(A Method for Driving an Inkjet Head)

Next, a preferred embodiment of the drive method of an inkjet head according to the present invention will be described.

Inventors of the present invention have conducted extensive research on regular uneven pressures generated when an inkjet head having a damper member in the common ink chamber is driven at a high speed to find a regular period according to acoustic resonance period of a pressure chamber. Since the pressure in the pressure chamber changes from positive to negative or negative to positive according to acoustic resonance period, a predetermined phase difference is provided between one drive timing and a subsequent drive timing according to a period generated by the uneven pressure, and an uneven pressure can be offset by changing the timing so that the pressure between the drive groups is a combination of a positive pressure and a negative pressure.

The method for driving an inkjet head according to the present invention divides all the pressure chambers into N drive groups and shift the drive timing by (2n−1)AL according to drive group. Herein, N is an integer of 2 or more and n is a number satisfying $0.8<n<1.2$. Acoustic length (AL) is one half of the acoustic resonance period in a pressure chamber. Accordingly, since the timing between different drive groups is shifted almost by an odd number of AL, the pressure according to drive group can be composed of a combination of a positive pressure and a negative pressure to practically offset the uneven pressure. Accordingly, generation of an uneven concentration can be controlled, thereby making it difficult to visually confirm the uneven concentration. In addition, by shifting the drive timing according to drive group, particularly during high-speed drive, the load on a drive circuit can be reduced. Consequently, an effect of reducing waveform dullness by heating and loading can be provided.

AL is calculated as a pulse width so that the flight speed of an ink droplet is a maximum value, by measuring the speed of an ink droplet ejected when a drive signal of a square wave is applied to a driving electrode of a pressure chamber (channel 121, pressure chamber 213*a*) and changing the pulse width of the square wave on condition that the voltage of the square wave is constant. A pulse refers to a square wave having a constant peak voltage peak defining 0V as 0% and a peak voltage as 100%, and the pulse width is defined as a duration from 10% of a rise time to from 0V to 10% of a fall time from the peak voltage. The square wave refers to a waveform whose rise time and fall time between 10% and 90% of the voltage are both within one half of AL, preferably within ¼ thereof.

Figure 7:
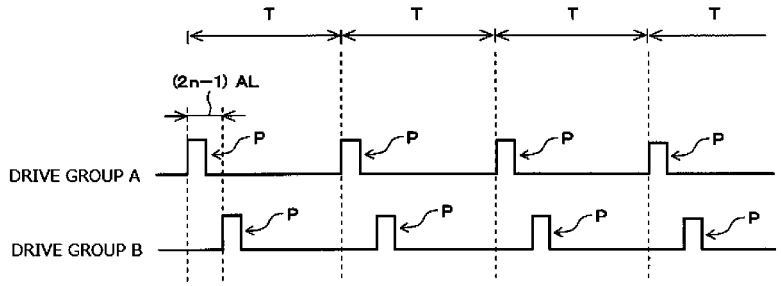
FIG. 7 is a diagram showing one example of a timing diagram when a driving signal is applied to a driving electrode of each of 2 drive groups divided.

FIG. 7 shows one example of a timing diagram when a driving signal is applied to a driving electrode of each drive group in cases where drive groups are divided into 2 groups: A and B. A phase difference of ((2n−1))AL is given to the drive groups A and B thus divided. Specifically, one driving signal P is applied to each drive period T of the drive group A, and the drive group A is driven earlier than the drive group B. Illustrative example of a waveform of each driving signal P is not particularly restricted. The pulse width PW is not particularly restricted, but it can be set at near-1AL when the pressure in the pressure chamber changes from negative to positive, specifically in the range of 0.8AL or more and 1.2AL or less.

A drive group refers to a group of pressure chambers which apply a driving signal with the same timing in a drive period of an inkjet head. The drive group is preferably determined according to row of pressure chambers as a unit. Accordingly, a pressure wave which is propagated over rows of pressure chambers can effectively be offset. In this case, each pressure chambers in the same row belongs to the same drive group. All the pressure chambers in the same drive group are simultaneously driven. The drive group may include a plurality of rows of pressure chambers.

In cases where the number of rows of pressure chambers is 3 or more, adjacent rows of pressure chambers preferably belong to different drive groups. Specifically, since rows of pressure chambers which belong to at least one different drive group are disposed between rows of pressure chambers which belong to the same drive group, the separation distance in the same drive group driven by the same timing becomes larger according thereto, and the impact of crosstalk in the same drive group can be reduced.

In cases where the number of drive groups divided is 3 or more, a decrease in landing precision is preferably avoided by setting all n values in a phase difference of ((2n−1))AL between the drive groups at 1.

The drive frequency in the inkjet head is preferably 15 kHz or more. As a pressure chamber is driven with a high-frequency of 15 kHz or more, the above-described problem of an uneven pressure is significantly caused and an effect of reducing generation of the uneven pressure becomes significant.

EXAMPLE

Example 1

By using a head chip comprising 4 rows of channels arranged, each composed of a partition wall containing a piezoelectric element and a straight-shaped channel alternately disposed, a shearing mode type inkjet head was configured as in FIGS. 1 and 2. The number of channels comprising one row was 256, and distances d1 to d3 between ink inlets in rows of channels (FIG. 4) were 0.85 mm ( d1), 1.13 mm ( d2) and 0.85 mm ( d3).

A damper member having a sealed air in a damper chamber was disposed in a common ink chamber so as to come near ink inlets. The damper member sealed the air inside thereof by attaching a damper wall composed of a polyimide film to one surface of an aluminum-made housing in atmosphere (60° C.). The damper member was large enough to cover all the ink inlets, and was disposed in parallel with a substrate so that the shortest distance D between the damper wall and any ink inlet is 0.3 mm.

Measurement of AL Fluctuation

In cases where the impact of crosstalk is generated between rows of channels, the ejection property of a channel shows fluctuation. AL (one half of the acoustic resonance period) of a channel of an inkjet head is originally and uniquely determined according to channel. If the impact of crosstalk is significant, AL shows fluctuation from the impact of a drive of adjacent channels. Therefore, AL fluctuation is measured to examine the extent of the impact of crosstalk generated.

To this end, AL fluctuation of a channel is measured to evaluate the extent of the impact of crosstalk generated between rows of channels.

First, 10 optional channels were selected from a central portion and an end of an inkjet head. When the inkjet head was driven by the following drive patterns (1) to (6), each AL of the 10 channels selected was measured to compare AL fluctuation by each drive pattern. AL value was obtained by measuring a pulse width which maximizes the ejecting speed when a pulse of a square wave was applied to the inkjet head to eject an ink droplet from nozzles.

(1) Drive of only 1 channel (2) Drive of all one row of channels (256 channels)

(3) Drive of 2 adjacent rows of channels (512 channels)

(4) Drive of 3 rows of channels (768 channels)

(5) Drive of 4 rows of channels (1024 channels)

(6) Drive of all 4 rows of channels every other nozzle (512 channels)

AL fluctuation was obtained by an equation of (|Xmin−Xmax|/Xmin)×100(%) by calculating AL average value from each value of AL measured for 10 channels according to each of the above drive patterns and defining the minimum of the AL average value as Xmin and the maximum thereof as Xmax.

Evaluation criteria are as follows.

○: AL fluctuation by drive pattern is under 2%

Δ: AL fluctuation by drive pattern is 2% or more and under 5% x: AL fluctuation by drive pattern is 5% or more

When AL fluctuation is under 2%, the impact of crosstalk is slight, the ejecting speed of an ink droplet ejected from the nozzles is stable in each nozzle, and an image obtained shows no obvious unevenness. When AL is 2% or more, a variation in ejecting speed of an ink droplet from crosstalk is generated to show uneven concentration in an image, thereby causing a problem with recording of a high-definition image. When AL is 5% or more, a variation in ejecting speed of an ink droplet from crosstalk becomes larger, thereby causing more obvious unevenness of an image obtained.

Table 1 shows the results.

Example 2

The same conditions as in Example 1 were employed to measure AL fluctuation for evaluation except for the shortest distance D between a damper wall and an ink inlet of 0.5 mm. Table 1 shows the results.

Comparative Example 1

The same conditions as in Example 1 were employed to measure AL fluctuation for evaluation except for the shortest distance D between a damper wall and an ink inlet of 1.0 mm. Table 1 shows the results.

Comparative Example 2

The same conditions as in Example 1 were employed to measure AL fluctuation for evaluation except for no preparation of a damper member in a common ink chamber. Table 1 shows the results.

TABLE 1

| | Example 1 | Example 2 | Comparative Example 1 | Comparative Example 2 |
|---|---|---|---|---|
| AL fluctuation | Maximum 0.8% | Maximum 0.9% | Maximum 2.3% | Maximum 7% |
| Evaluation | ○ | ○ | Δ | x |

As described above, in Examples 1 and 2 in which the shortest distance D between the damper member and the ink inlet is shorter than distances d1 to d3 between ink inlets between 4 rows of channels, AL fluctuation was small, and the impact of crosstalk between rows of channels was reduced.

Scratch Drawing Test

<Scratch Drawing Test 1>

As for Examples 1 and 2, Comparative Examples 1 and 2, a scratch drawing test was performed for a solid image by driving all the channels with drive frequencies of 14 kHz, 10 kHz and 60 Hz by means of scanning an inkjet head in a direction orthogonal to a lengthwise direction of rows of channels.

A solid image was used because the number of channels to be simultaneously driven is large, the impact of crosstalk is significant and it is easy to visually confirm uneven concentration after ink landing.

Figure 8:
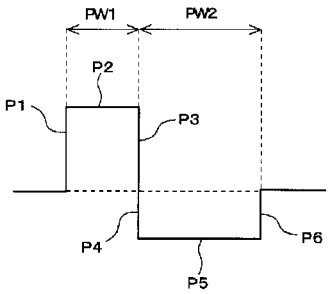
FIG. 8 is a diagram showing one example of a drive waveform.

A DRR waveform shown in FIG. 8 was used as a drive waveform. The drive waveform comprises a pulse P1 which expands the volume of a channel by externally deforming a pair of partition walls of both sides of the channel to a dogleg shape, a pulse P2 which maintains the pulse P1 for a certain period of time, a pulse P3 which restores the deformed and expanded partition walls after the pulse P2, a pulse P4 which contracts the volume of the channel and pushes an ink in the channel out of nozzles by internally deforming the pair of partition walls to a dogleg shape after the pulse P3, a pulse P5 which maintains the pulse P4 for a certain period of time, and a pulse P6 which restores the deformed and contracted partition walls after the pulse P5. The maintenance period of the pulse P2 (PW1) was 5.1 μs (=1AL), and the maintenance period of the pulse P5 (PW2) was 10.2 μs (=2AL).

After visual confirmation of an image obtained, in Examples 1 and 2, a uniform solid image with no uneven concentration was obtained at both drive frequencies. This observation means that the amount of an ink droplet according to row of channels is made uniform.

However, in Comparative Example 1, uneven concentration was slightly obvious at 14 kHz. In Comparative Example 2, strip-shaped uneven concentration was obvious at a frequency other than 60 Hz.

<Scratch Drawing Test 2>

Next, in Examples 1 and 2, by using the same driving signal as the above test 1, all the channels were driven at a drive frequency of 15 kHz to record a solid image. Uneven concentration attributed to uneven pressure generated by high-frequency drive was slightly found.

Thereafter, 4 rows of channels were divided into 2 drive groups A and B. The drive timing between the drive groups was shifted by 5.1 μs (=1AL) to drive all the channels at a drive frequency of 15 kHz. The drive groups were divided into drive groups A, A, B and B from an end row of channels with a row of channels as a unit.

Consequently, in both Examples 1 and 2, uneven concentration was not obvious and the impact of uneven pressure generated during high-frequency drive was reduced.

The entire disclosure of Japanese Patent Application No. 2013-176017, filed on Aug. 27, 2013 and Japanese Patent Application No. 2014-109140, filed on May 27, 2014 including description, claims, drawing, and abstract are incorporated herein by reference in its entirety. Although various exemplary embodiments have been shown and described, the invention is not limited to the embodiments shown. Therefore, the scope of the invention is intended to be limited solely by the scope of the claims that follow.

EXPLANATION OF LETTERS AND NUMERALS

1: Inkjet head
11: Nozzle plate
111: Nozzle
12: Head chip
121: Channel (Pressure chamber)
121*a*: Ink outlet
122: Partition wall
13: Substrate
131: Through hole
131*a*: Ink inlet
14: Ink manifold
141: Common ink chamber
141*a*: Ink flow passage
142: Rear inner wall surface
15: Damper member
151: Housing (Damper frame)
152: Damper chamber
153: Damper wall (flexible film)
154: Leg portion
2: Inkjet head
21: Head substrate
211: Nozzle plate
211*a*: Nozzle
212: Intermediate plate
212*a*: Communicating path
213: Pressure chamber plate
213*a*: Pressure chamber
214: Diaphragm
214*a*: Opening
215: Actuator
22: Wiring substrate

221: Ink supply channel
221*a*: Ink inlet
23: Adhesive resin layer
231: Through hole
24: Ink manifold
241: Common ink chamber
25: Damper member
251: Damper frame (housing)
252: Flexible film (damper wall)
253: Damper chamber
26: External wiring member
P: Driving signal
PW: Pulse width

What is claimed is:

1. An inkjet head, comprising:

pressure chambers arranged in two or more rows; and a common ink chamber connected to all the pressure chambers, each of the pressure chambers accepting an ink commonly supplied from the common ink chamber via an ink inlet which faces the common ink chamber and ejecting the ink from nozzles connected to an ink outlet of the pressure chambers due to a change in pressure generated in the pressure chambers, the inkjet head further comprising a damper member inside of the common ink chamber, wherein the shortest distance between the damper member and the ink inlet is shorter than the distance between the ink inlets in adjacent rows thereof;

wherein the damper member comprises a damper chamber having a sealed gas;

wherein the pressure inside of the damper member is atmospheric pressure or less when the temperature of an ink of the common ink chamber reaches the working temperature.

2. The inkjet head according to claim 1, wherein the shortest distance between the damper member and any of the ink inlets is the same.

3. The inkjet head according to claim 2, wherein the common ink chamber comprises only one damper member, wherein the damper member is disposed so as to bridge across all the rows of the pressure chambers.

4. The inkjet head according to claim 3, wherein the damper member includes all the ink inlets when the damper member is projected from a direction perpendicular to a plane where the ink inlets are present.

5. The inkjet head according to claim 1, wherein the ink inlet, the ink outlet and the nozzles are disposed on a straight line and the straight line and the damper member intersect.

6. The inkjet head according to claim 5, wherein a partition wall between adjacent pressure chambers contains a piezoelectric element, and an ink in the pressure chambers is pressurized due to deformation of the partition wall to eject the ink from the nozzles.

7. The inkjet head according to claim 1, wherein a member having a volume elastic modulus of 40 GPa or more is disposed in parallel with the damper member around the ink inlets.

8. The inkjet head according to claim 1, wherein the damper member is formed of a flexible film on at least one face of a housing, the damper chamber is formed of the housing and the flexible film, and the flexible film is disposed so as to face the ink inlets.

9. The inkjet head according to claim 8, wherein the housing contains a metal.

10. The inkjet head according to claim 1, wherein the damper member is a plate member obtained by forming a wall surface which faces at least the ink inlets of a material having a volume elastic modulus of 40 GPa or less.

11. The inkjet head according to claim 1, wherein one wall surface of the pressure chamber is formed of a diaphragm obtained by laminating piezoelectric elements, and an ink in the pressure chambers is pressurized due to vibration of the diaphragm to eject the ink from the nozzles.

12. A method for driving an inkjet head, the inkjet head comprising:

pressure chambers arranged in two or more rows; and a common ink chamber connected to all the pressure chambers, each of the pressure chambers accepting an ink commonly supplied from the common ink chamber via an ink inlet which faces the common ink chamber and ejecting the ink from nozzles connected to an ink outlet of the pressure chambers due to a change in pressure generated in the pressure chambers, the inkjet head further comprising a damper member inside of the common ink chamber, wherein the shortest distance between the damper member and the ink inlet is shorter than the distance between the ink inlets in adjacent rows thereof, the pressure chambers are divided into N drive groups: N is an integer of 2 or more, and the drive timing is shifted by (2n-1) AL: $0.8<n<1.2$, AL is one half of the acoustic resonance period of the pressure chambers according to each of the drive groups.

13. The method for driving an inkjet head according to claim 12, wherein the drive groups are divided according to a row of the pressure chambers as a unit.

14. The method for driving an inkjet head according to claim 13, wherein adjacent rows of the pressure chambers are divided into the different drive groups.

15. The method for driving an inkjet head according to claim 12, wherein the drive frequency is 15 kHz or more.

* * * * *